US006530485B1

(12) United States Patent
Weber

(10) Patent No.: US 6,530,485 B1
(45) Date of Patent: Mar. 11, 2003

(54) DISPLAY UNITS AND BRACKET SYSTEM

(75) Inventor: Karl F. Weber, Moose, WY (US)

(73) Assignee: Uniweb, Inc., Corona, CA (US)

( * ) Notice: Subject to any disclaimer, the term of this patent is extended or adjusted under 35 U.S.C. 154(b) by 188 days.

(21) Appl. No.: 09/648,333

(22) Filed: Aug. 25, 2000

(51) Int. Cl.[7] ..... B42F 7/00
(52) U.S. Cl. ..... 211/55; 211/128.1
(58) Field of Search ..... 248/250; 211/55, 211/128.1, 56, 129.1

(56) References Cited

U.S. PATENT DOCUMENTS

| | | | | | |
|---|---|---|---|---|---|
| 188,519 | A | * | 3/1877 | Lamoree | |
| 888,323 | A | | 3/1908 | MacDuff | |
| 1,702,937 | A | | 2/1929 | Friedemann | |
| 2,141,008 | A | | 12/1938 | Meyer | |
| 2,261,078 | A | | 10/1941 | Shockey | |
| 2,532,600 | A | * | 12/1950 | Browesma | 211/55 |
| 3,198,340 | A | * | 8/1965 | Tokash | |
| 3,202,296 | A | | 8/1965 | Diack | |
| 3,212,836 | A | | 10/1965 | Johnson | |
| 3,298,538 | A | * | 1/1967 | Ganz et al. | 211/55 |
| 3,347,355 | A | | 10/1967 | Cavender | |
| 3,912,085 | A | | 10/1975 | Cooke et al. | |
| 3,985,083 | A | | 10/1976 | Pofferi | |
| 4,613,047 | A | * | 9/1986 | Bushyhead et al. | 211/55 |
| 4,938,366 | A | * | 7/1990 | Carroll | 211/55 |
| 5,758,781 | A | * | 6/1998 | Lord et al. | 211/55 |
| 5,938,048 | A | * | 8/1999 | Carroll et al. | 211/55 |

FOREIGN PATENT DOCUMENTS

| | | | | |
|---|---|---|---|---|
| FR | 864066 | | 1/1941 | |
| GB | 1482997 | * | 8/1977 | 211/55 |

* cited by examiner

*Primary Examiner*—Korie Chan
(74) *Attorney, Agent, or Firm*—Oppenheimer, Wolff & Donnelly

(57) ABSTRACT

A bracket system for a display unit can be arranged in a tiered array, one bracket depending from the other. Each bracket includes a back portion, a base and a front portion. The front is shorter than the back portion and the back of each bracket depends from the front of the prior bracket, thereby to provide a progressive tiered array of displays depending downwardly from the first bracket towards subsequent lower arranged brackets to form a display arrangement.

3 Claims, 5 Drawing Sheets

DISPLAY UNITS AND BRACKET SYSTEM

BACKGROUND OF THE INVENTION

This invention relates to a display system and brackets for the display system. In particular, it relates to brackets for inter-association with each other to promote for altered and multiple display arrangements as selected for a user.

Display systems typically include a back panel provided with a surface to attach display fixtures. One of those systems can be a conventional pegboard panel having regular horizontal if and vertical patterns of holes through which different fixtures can be attached. Another panel sold by the Assignee of this Application under the trade name Uniweb® (a trademark of Uniweb, Inc.) has horizontal gripping ridges at regular intervals from which fixtures can be securely hooked. It is desirable to have such panels arranged so that different display elements can be located on the display panel in a manner to provide increased versatility so that the merchandiser can arrange the display according to the desired end user need. This end user need may be retail display of merchandise, such as literature or magazines, or alternatively it can be of a service nature for holding different materials such as books, literature or other features, for instance in a medical practice.

The different known systems are unduly complicated to fabricate or have limited versatility.

This invention is directed to providing an improved display system which minimizes the disadvantages of prior known displays and brackets for such displays.

SUMMARY OF THE INVENTION

According to the invention, a bracket for display is provided. The bracket includes a back member for hooking onto a panel, a base from the back member and a front portion. The front portion is preferably shorter than the back portion and provides for supporting the back portion of a subsequent bracket. The profile of the first bracket and the second bracket are substantially the same in transverse cross section. Subsequent third and fourth brackets can have similar or the same cross-sectional profiles. The lengths of each of these brackets can vary and in this manner, different lengths of brackets and display units are provided.

By having the tiered arrangement of brackets, one bracket depending from a prior bracket, and wherein the first bracket is supported by the panel, there is provided an effective system for displaying products and services in a tiered arrangement tending downwardly and forwardly. Such brackets can be made of any suitable material, the brackets having an appropriate cross section of different lengths to provide the requisite displays.

By this invention there is provided a combination bracket and display device which is an effective improvement over prior display and bracket systems.

The invention is further described with reference to the accompanying drawings.

DETAILED DESCRIPTION OF THE PREFERRED EMBODIMENT

Figure 1:
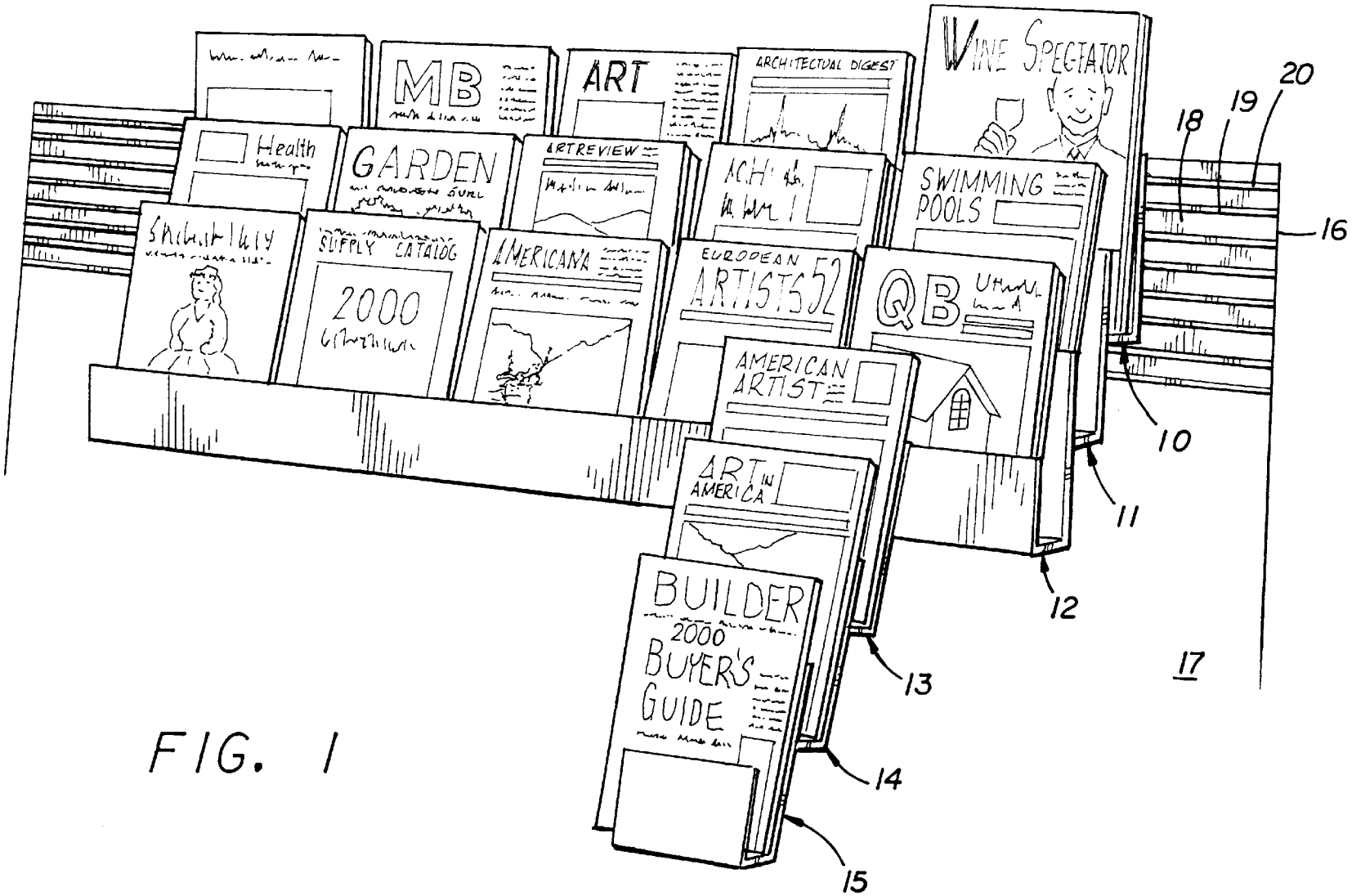
FIG. 1 is a perspective view showing multiple display devices in tiered arrangement depending from a panel, with magazines shown in the display panels.
Figure 2:
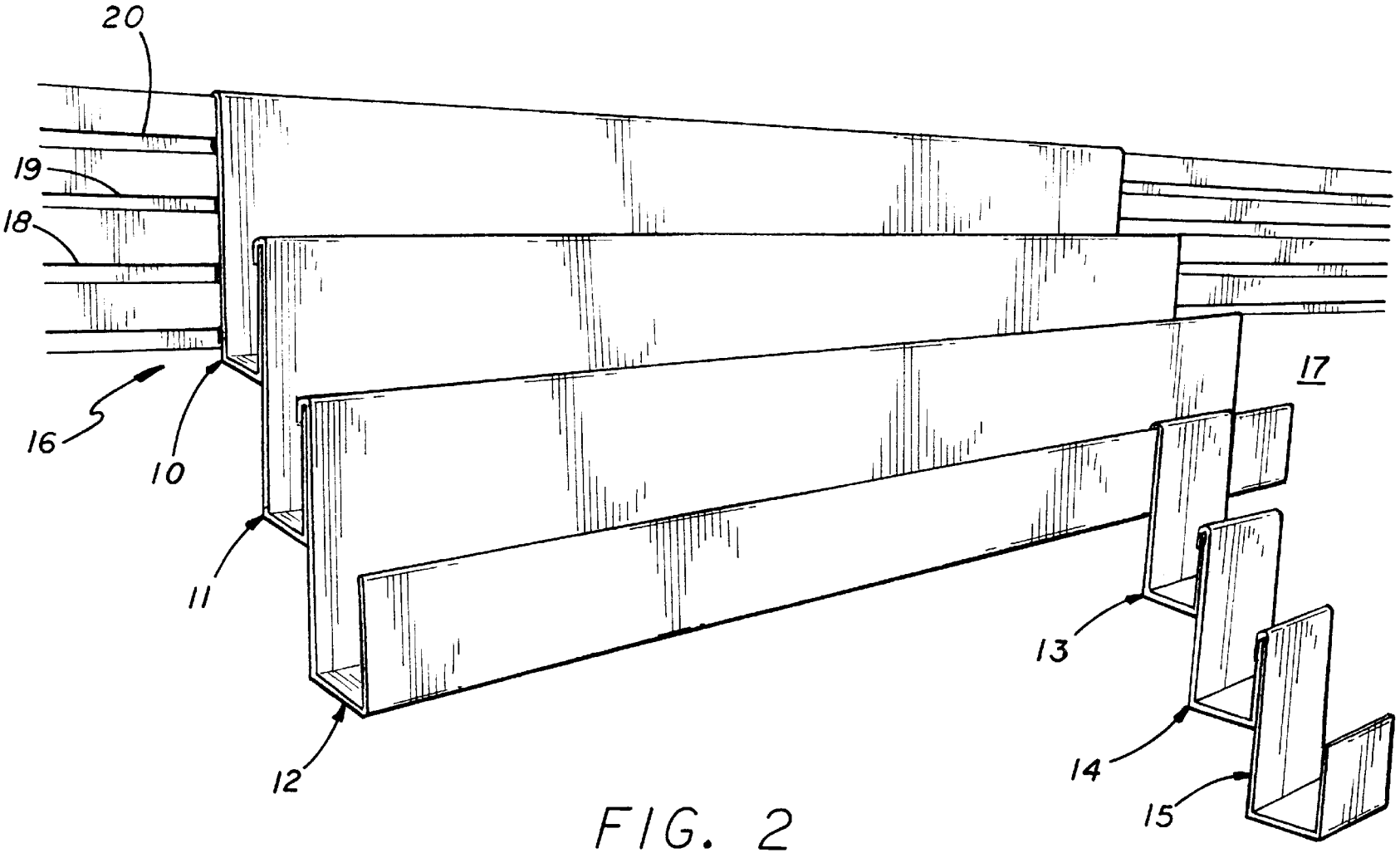
FIG. 2 is a perspective view from the opposite side showing the display device mounted on the panel without the magazines.
Figure 3:
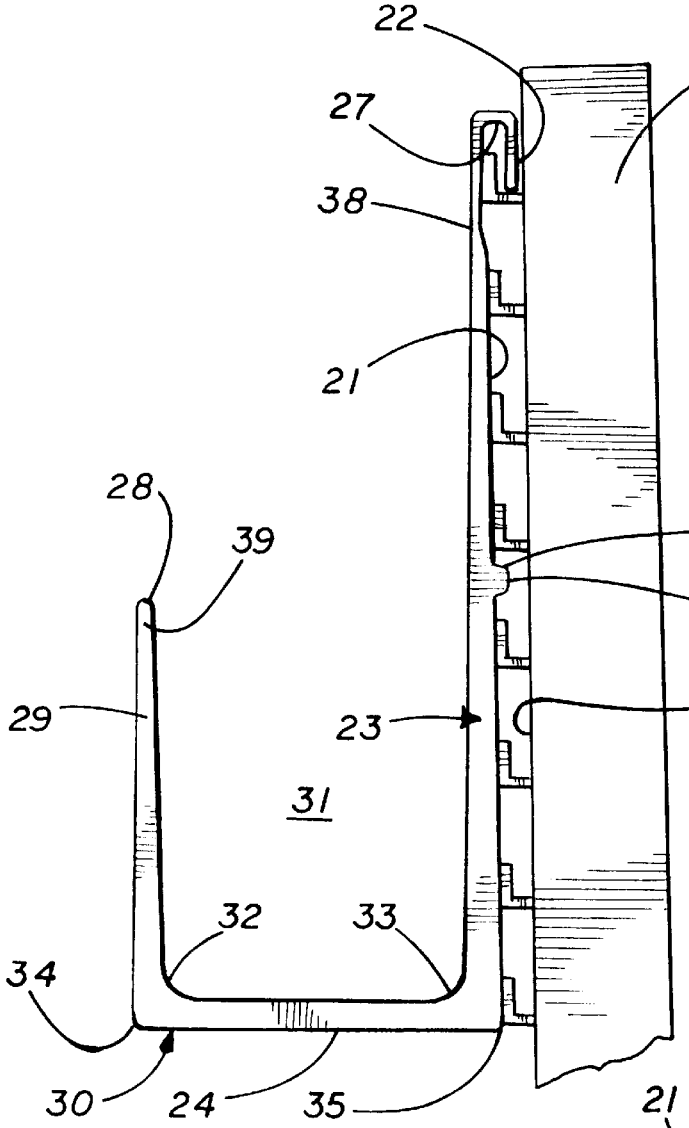
FIG. 3 is a side view of a bracket in accordance with the invention.

A tiered array of display units or shelves 10, 11, 12, 13, 14, and 15 is sequentially supported on a vertical panel 16. The vertical panel 16 includes a front face 17 with horizontally extending rail-like members 18 each of which provides a hook face upwardly directed formation 19 in spaced relationship. Between each hook arrangement there is effectively a space 20 into which a hook formation from a first bracket can be connected.

Figure 4:
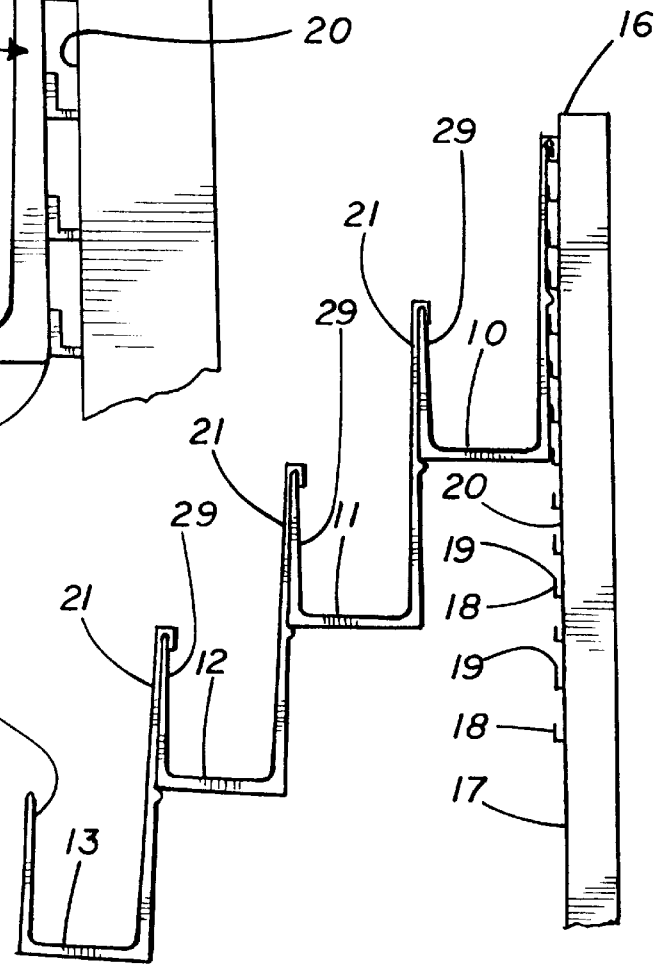
FIG. 4 is a side view of the panel in a tiered bracket arrangement, one bracket depending from the other in accordance with the invention.

In the arrangement shown in the figures, the panel 16 is vertically disposed, for instance as illustrated in FIG. 4. In other forms of the invention, the panel 16 can be angled appropriately, for instance up to 10 and preferably about 8 degrees forwardly. Thus, it would tilt so that the base portion is ahead of the top portion of the panel 16.

A first bracket for securing the multiple display units includes a back portion 21 which includes a hook element 22 for engaging in the hook 19 on the display panel. The hook element 22 includes a rearwardly and downwardly spaced element directed to behind the portion 21. The top of the back portion 21 is relatively narrowed to the mid-portion 23 of the back portion. The back portion effectively tapers from a narrow portion towards the top to a thickened portion towards a base 24 for the bracket.

Also protruding rearwardly from the base 21 is a protrusion element 25. The space between the top 26 of the protrusion 25 and the internal top 27 of the hook 22 is spaced to be substantially equal to the height between a top lip 28 of a front portion 29 and the bottom 30 of the front portion 29. As such, the front portion 29 of an adjacent bracket can fit between that space in a mating accommodating arrangement. Between the back portion 21 and front portion 29 there is located the base portion 24 to provide a space 31 for accommodating merchandise to be displayed. Between the top portion 28 and the bottom portion 30 of the front portion there is a tapered formation wherein the top is narrower than the base portion 30 of the front portion. The base portion 24 is substantially equal in depth between the front and the back. Each of the internal corners 32 and 33, and external comers 34 and 35 are camphored or rounded appropriately. The top 28 of the front face 29 and top of the panel 23 are also rounded or camphored appropriately.

When a second bracket 11 depends from the first bracket 10, the back portion 21 depends from the front portion 29 of a prior bracket. In this manner, an effective tiered arrangement of brackets is provided which depends downwardly from the back towards the front and permits for an effective display for merchandise.

Figure 5:
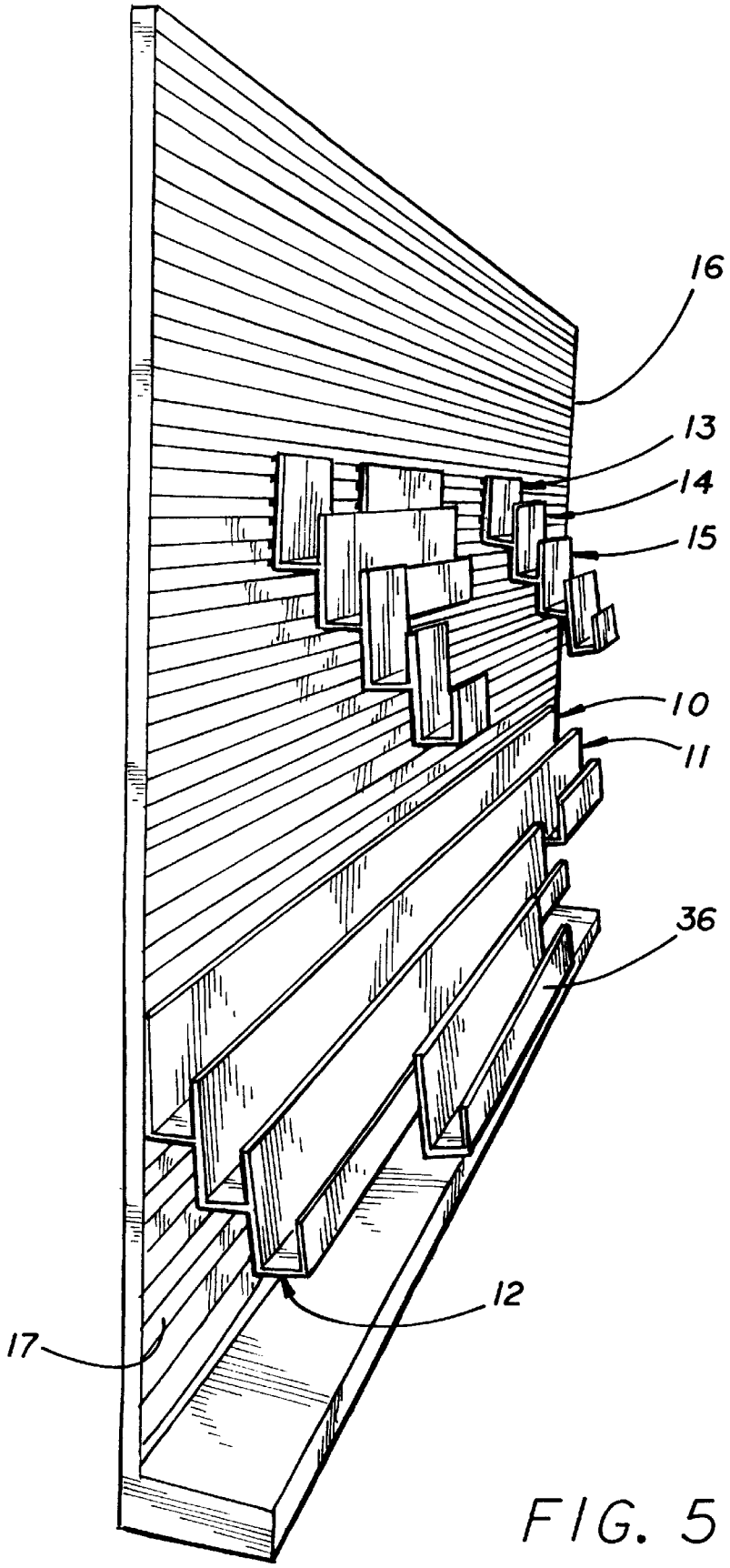
FIG. 5 is a perspective view of the panel and multiple brackets in tiered arrangement.
Figure 6:
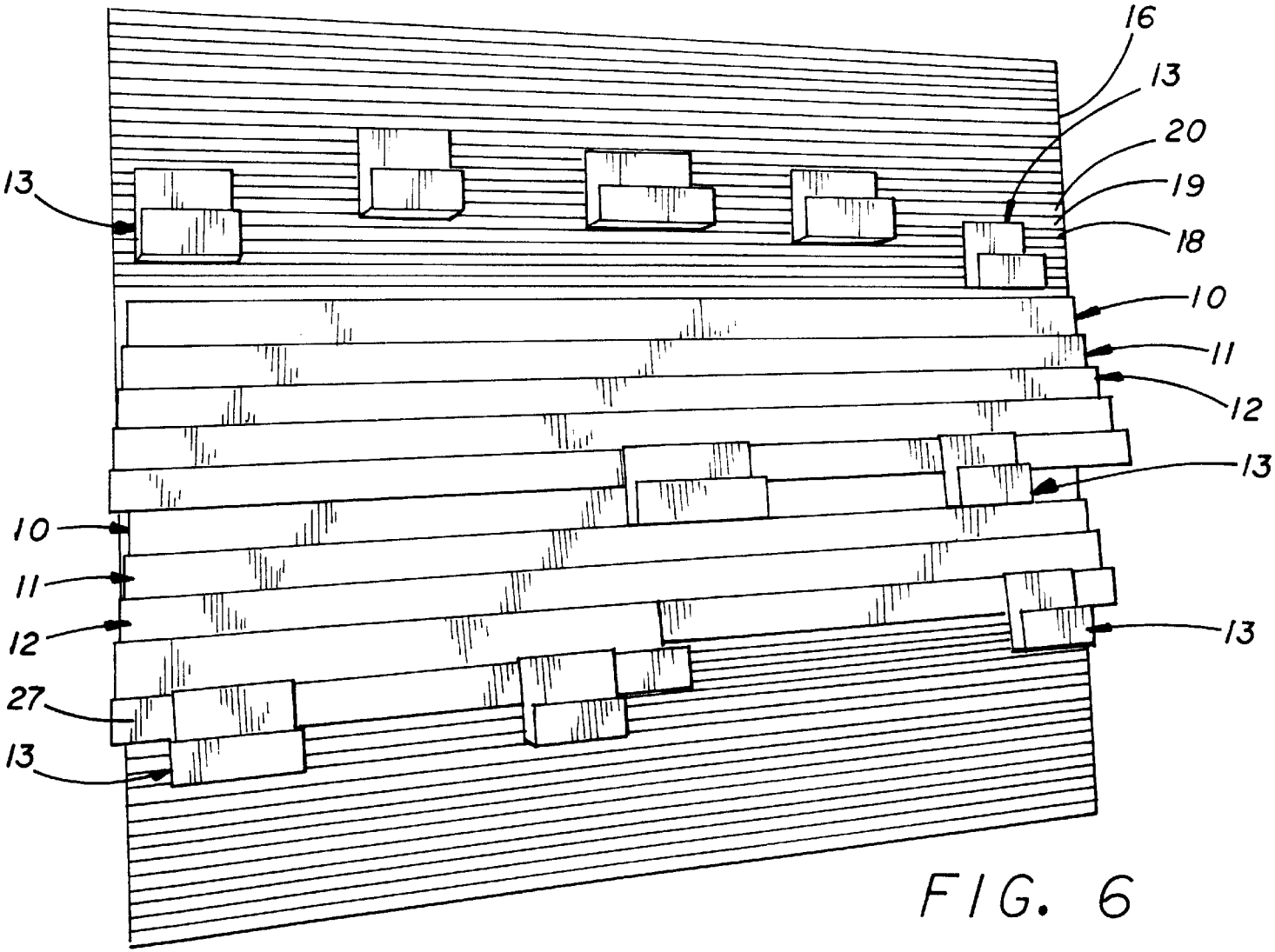
FIG. 6 is a perspective view showing different display units depending from a panel.

As shown, the cross-sectional profile of brackets 10, 11, 12 and 13 are substantially the same. This permits for effective extrusion of different bracket formations for the display unit. The different display units or brackets can be of different lengths. Thus the lengths of the display units 13, 14 and 15 are shorter than that of 10, 11 and 12, as can be seen in FIG. 11 Similarly, as shown in FIG. 5, there is a display unit 36 of different lengths. In FIG. 6, there is the display unit 37 of different lengths. In this manner, different display configurations can be achieved.

The extrusion method for forming these brackets effectively requires a mold of a suitable shape to be formed through which the extruded bracket can be formed. The extrudable material can be aluminum, acrylic or other suitable moldable material.

Although the length of the base portion 24 of each of the brackets 10, 11, 12 and 13 are shown to be substantially equal, there can be configurations where the length of the base 24 varies from one bracket to another. In this manner, different display configurations can be provided.

Inside, towards the top of the back portion 21 there is a thinned portion 38 which forms part of the hook 22. This provides for sufficient flexibility and accommodation of the lip 39 at the top 28 of the front portion 29. To the appropriate degree, sufficient springiness may be provided by having the portion 38 thinned effectively.

Although the invention is being described with reference to U-shape type display elements, which each effectively provides a tray to receive display materials, there could be other forms of the invention.

Many of the forms of the invention exist, each differing from the other in matters of detail only.

In one other system of display, for instance, there could be protruding, horizontal shelf-type formations provided at a discrete location from the back portion. The shelf can have formations which extend forwardly or be sufficiently strong to support product at each level. For instance, a shelf-type formation extending forwardly can be located at a location slightly upwardly of the rearwardly protruding portion 25. This would be at a slightly higher level than the top 28 of the front portion. It should be sufficiently spaced so that the back portion of a subsequent bracket can fit and be connected to the front portion of a prior bracket element.

Horizontal or angular shelf portions or the like may extend out to different lengths. In such a formation it may not be necessary to have the U-shape formation bracket, with front, base and back portions in a similar fashion to that shown in the figures. The means for supporting shelves in the tier-type arrangement may or may not include the actual shelf itself or it could just be means for supporting a separately fitted shelf arrangement or the like.

Although a panel is disclosed as the support for the bracket, there can be other situations having a different support for the first bracket of the tiered system.

The invention is to be determined in terms of the following claims.

What is claimed is:

1. A display system comprising a base panel and a tiered arrangement of an array of display elements sequentially self-supported, one from the other without the need of a direct support for the sequential elements from said base panel except for a first one of said display elements supported on said base panel where said base panel includes a plurality of vertically spaced and horizontally extended rail formations with slots, the slots having a generally upwardly hook-formed cross-sectional profile in said panel base said array of display elements comprising at least a first bracket for securing a first display unit in adjacent relationship with the base panel the first bracket including:

a back portion, including an element for holding said first display unit adjacent to the lease panel;

a front portion spaced from the back portion, the front portion having a lip towards a top of the front portion;

a base portion between the back portion and the front portion;

a second bracket with a back portions including a support element for holding a second display unit adjacent the first bracket;

the front portion being shorter than the back portion of the first bracket and the front portion permitting the second bracket to depend from the front portion is said support elements with the back portion of the second bracket being in adjacency with the front portion of the first bracket;

a rearwardly directed non-hook protrusion from a back portion of the second bracket for engaging matingly an underside of the base portion of the first bracket;

a taper from the top of the back portion of the first bracket to be of increasing thickness towards the base portion of the first bracket, the back portion of the first and second bracket being a non-resilient material; and rounded corners internally and externally between the front portion and base portion, and the base portion and back portion of the first bracket.

2. A display system as claimed in claim 1 wherein the second bracket support element is a hook which hooks onto the top of the front portion of the first bracket.

3. A display system as claimed in claim 1 wherein the second bracket includes a front portion and a base portion connecting the back portion and the front portion of the second bracket and wherein said tiered array of display elements includes a plurality of said second brackets each depending from the other in the same configuration as the first and second bracket.

* * * * *